United States Patent [19]

Spanier

[11] Patent Number: 5,048,440

[45] Date of Patent: Sep. 17, 1991

[54] SAILING APPARATUS

[75] Inventor: Barry Spanier, Haiku, Hi.

[73] Assignee: Neil Pryde Limited, Hong Kong

[21] Appl. No.: 348,675

[22] Filed: May 8, 1989

Related U.S. Application Data

[63] Continuation-in-part of Ser. No. 345,767, May 1, 1989, abandoned.

[51] Int. Cl.[5] ..... B63B 35/79

[52] U.S. Cl. ..... 114/39.2; 114/102

[58] Field of Search ..... 114/102-112, 114/39.1, 39.2, 89, 90, 97, 98

[56] References Cited

FOREIGN PATENT DOCUMENTS 0191420 8/1986 European Pat. Off. ..... 114/103

8707234 12/1987 World Int. Prop. O. ..... 114/103

OTHER PUBLICATIONS

Pamphlet re Sailing Devices sold by Tushingham.

Physical Sample of the "Optional External Inducer", by Tushingham.

European Search Report EP 90 30 4691.

International Search Report PCT/GB 87/00346.

DE-U-8 525 953 North Sails, Patent Document G 85 25 953.5.

*Primary Examiner*—Ed Swinehart

*Attorney, Agent, or Firm*—Willian, Brinks, Olds, Hofer, Gilson & Lione

[57] ABSTRACT

A sailing apparatus includes a sail having a batten which is positioned relative to the mast by a coupling member which serves to induce a camber in the batten and enhance and stabilize the draft or curvature of the sail. The coupling member can be installed and removed while the sailing apparatus is fully rigged.

7 Claims, 4 Drawing Sheets

SAILING APPARATUS

STATEMENT OF RELATED APPLICATION

This application is a continuation-in-part of U.S. Ser. No. 07/345,767, Attorney Docket No. 2183/16 for a Sailing Apparatus, filed May 1, 1989, and now abandoned.

The present invention relates to sailing apparatus, and in particular to a coupling member for inducing a camber in a sail in a sailboard.

BACKGROUND

For may years it has been common practice to stiffen or tension sails by means of battens which extend generally horizontally across the sail. The battens are housed in pockets in the sail and may be forced into the pocket from an open end of the pocket at the trailing edge of the sail, to provide extra tension in the sail. The batten may be held tightly in the pocket by a strap and friction buckle arrangement.

In some arrangements, the battens extend across the full width of the sail and the end of the batten at the leading edge of the sail may be located on the mast. In sailboards, such a system has been found to be particularly useful in enhancing the performance of the sail. The user is able to induce or enhance the camber in the sail near the mast and the system may provide for a smooth, aerodynamic transition from the luff pocket of the sail, which encircles the mast, to the main body of the sail.

Examples of systems used in sailboards are seen in U.S. Pat. No. 4,625,671 (Nishimura), U.S. Pat. No. 4,649,848 (Belvedere), and U.S. Pat. No. 4,686,921 (Magnan). In all these systems the coupling member or socket, which locates the batten end at the mast and allows it to pivot about the mast, is located in the luff pocket. Generally several coupling members are used per sail, each locating a respective batten end. In practice, such systems complicate the rigging process and may require a lot of adjustment to keep them functioning properly.

Main purposes of the coupling member are to help form a stable leading edge, to induce draft in the sail, and to help stabilise that draft so that the sail maintains its aerodynamic foil shape in gusts, when accelerating, or at high speed. The systems described above, using a plurality of coupling members, can result in a foil shape which is too rigid, making the sail difficult to depower, for example by luffing, and they may inhibit rotation of the sail about the mast.

SUMMARY OF THE INVENTION

It has been realised that in sailboards draft movement aft of the sail at the boom height is very de-stabilizing because the sail is retained by the boom at the clew. This levers the sailor off balance, which forces him to sheet out or depower. When draft movement occurs at the head or top of the sail, the foil shape can twist open and the sail flattens which causes only minor handling problems.

Accordingly, it has been found that sail performance can be improved by providing only a single coupling member or socket, which locates the end of the main batten of the sail on the mast, in the region of the boom. The single coupling member located on the main batten, near the boom, enhances the power of the sail in this region, where the boardsailor is most able to handle the power.

Also, by locating the coupling member in a cut out area of the luff pocket, it is possible to provide a camber inducer which can be readily installed and removed whilst the sailboard is fully rigged.

It is thus possible to provide a system in which the performance of a standard sail, for example one designed for recreational use, can be improved by the simple addition of a coupling member, allowing the boardsailor to uprate the performance of his sailboard at will.

DESCRIPTION OF THE PREFERRED EMBODIMENT

Figure 1:
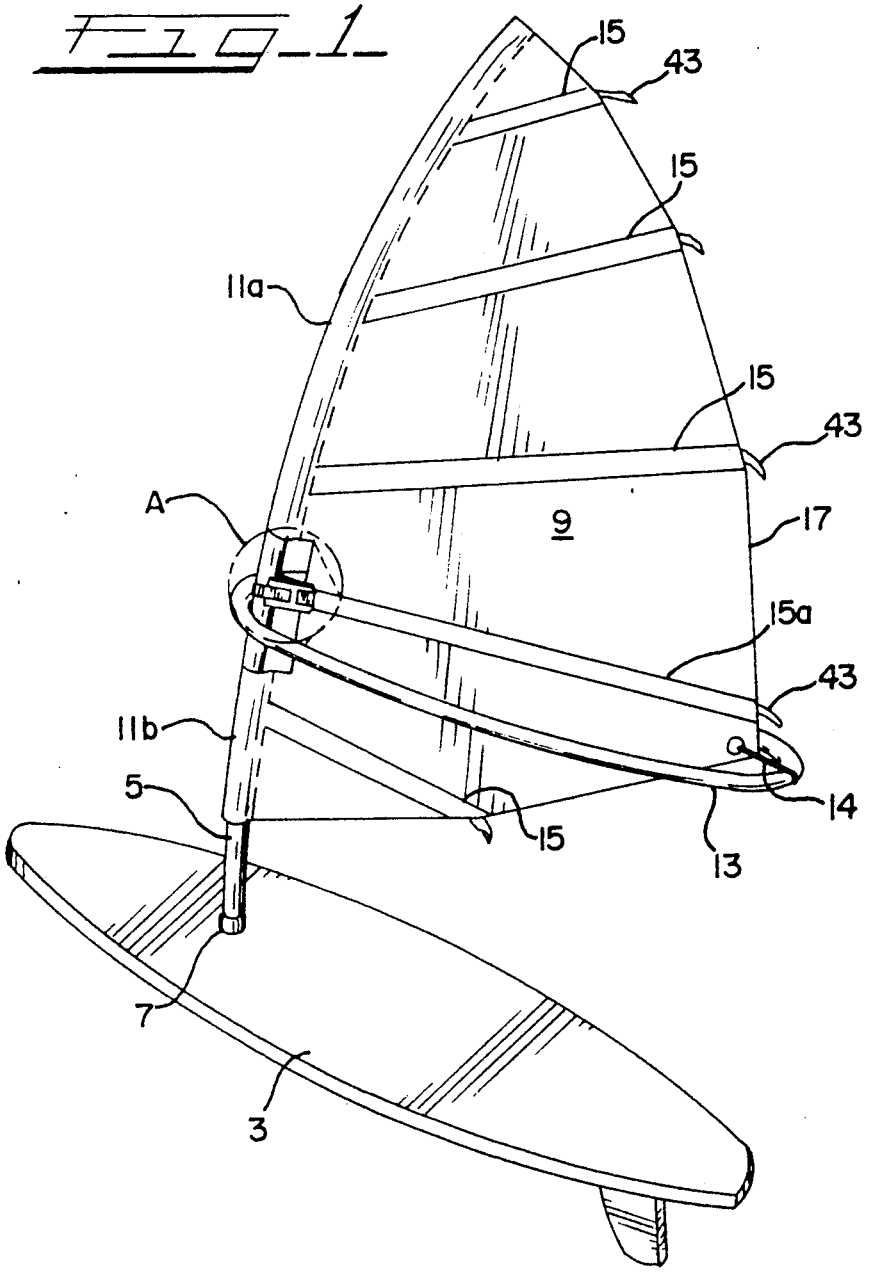
FIG. 1 is a perspective view of a sailboard in accordance with the invention.

Referring to the drawings, FIG. 1 shows schematically an embodiment of a sailboard 1 incorporating a coupling member in accordance with the invention. The sailboard 1 comprises a buoyant board 3, a mast 5 which extends upwardly from the board 3 and is mounted thereon by a universal joint 7, and a sail 9 carried on the mast 5. Sail 9 has a luff pocket 11 which encircles the mast 5 along substantially the full length of the mast 5. An arcuate wishbone shaped boom 13 stretches the sail 9 out from the mast and provides a grip for the user of the sailboard. Flexible battens (not shown in FIG. 1) are provided in batten pockets 15 which extend generally horizontally, that is transversely of the width of the sail.

The boom 13, which is attached to the trailing edge 17 of the sail by a clew 14, serves to tension the sail by pulling the sail away from the mast. The sail is also tensioned by pulling the luff pocket 11, which is closed at its upper end, down towards the board 3. This tensioning serves to induce a curvature in the mast 5, which in turn may induce a slight draft or curvature in the sail.

The arrangement thus far described is well known in the sailboard art.

In the example shown, the pockets 15 extend across the full width of the sail 9 from the trailing edge 17 to the luff pocket 11. The pockets 15, and hence the respective battens, are angled at different angles to the mast 5 according to their position on the sail 9. The main batten pocket **15*a* extends across the sail near its widest point, which is in the region of the boom 13. The pockets 15, including pocket 15*a* are closed at their forward ends adjacent the mast 5 and luff pocket 11, and open at their rearward ends at the trailing edge 17 of the sail. The battens are held in the pockets 15 by respective straps 43 which are sewn at one end to the sail, pass through an eye 47 at the end of the batten and then through a friction buckle 49 attached to the sail 9 (see FIG. 3). The straps 43 can be pulled tight to urge the battens into the pockets 15 and so stiffen the sail 9**.

Figure 2:
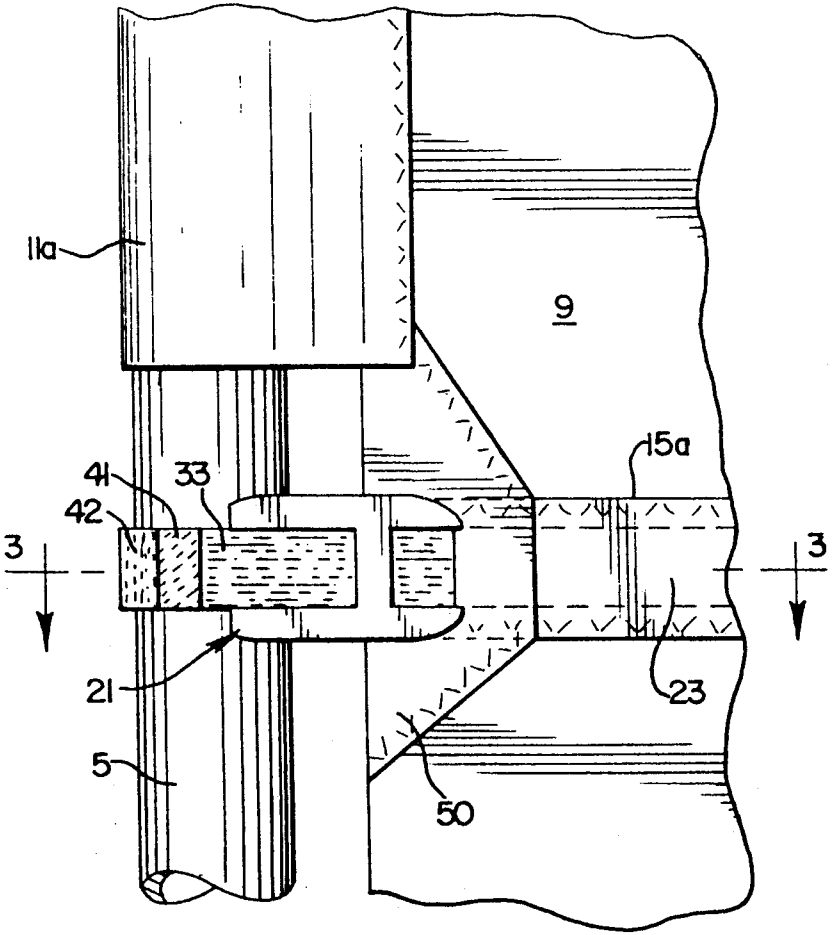
FIG. 2 is a detail view of the area A in FIG. 1.

From FIGS. 1 and 2 it can be seen that the luff pocket 11 is discontinued in the region of the boom 13 and the main batten pocket 15*a*, that is to say the luff pocket is in two portions, a first 11*a* which extends from above the main batten pocket 15*a* to the top of the mast 5, and a second 11*b* which extends from below the boom 13 to the lower end of the mast near the universal joint 7.

A readily removable coupling member 21 is positioned between the mast 5 and the forward end of the main batten pocket 15*a* to locate to the forward end of the respective batten 23 relative to the mast 5. The arrangement will be described in more detail with reference to FIGS. 3 and 4.

Figure 4:
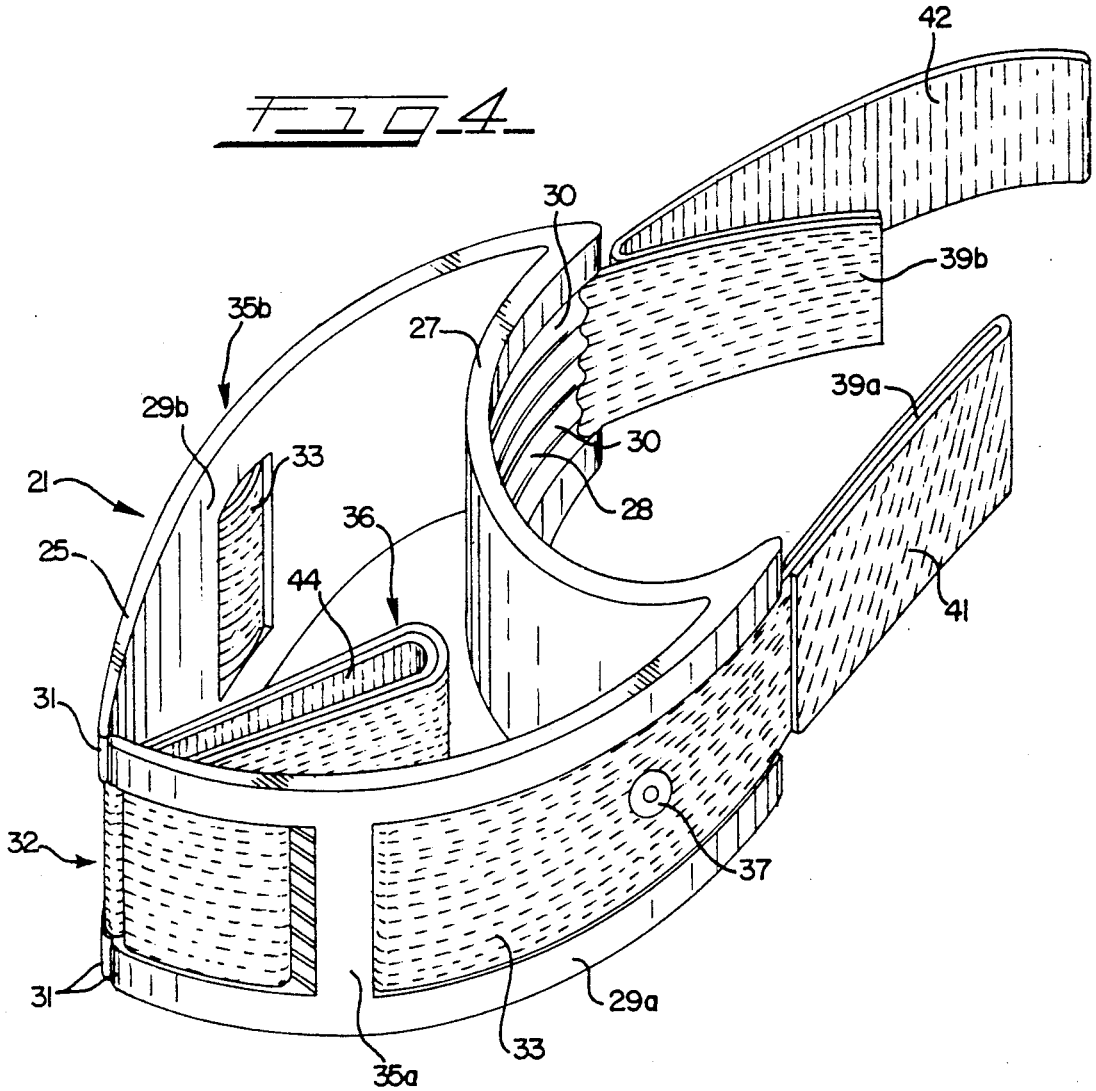
FIG. 4 is a perspective view of a coupling member in accordance with the invention.

Referring firstly to FIG. 4, the coupling member 21 comprises a body 25 integrally moulded from plastics material such as Nylon 6,6 and having an arcuate forward end 27 which fits snugly against the mast 5 and extends about 180 degrees around the mast, and two curved legs 29 which extend rearwardly from the ends of the arcuate end 27 and nearly touch at their rearward ends 31. The surface 28 of the end 27 which abuts the mast 5 has a series of arcuate cross-section ridges 30 running circumferentially of the mast 5. These help reduce the friction between the surface 28 and the mast, and the accompanying valleys between the ridges 30 allow sand to be squeezed from the bearing area where it would cause serious wear on the surfaces. The ends 31 are recessed to form an opening 32. The legs 29*a*, 29*b* are stiff relative to the batten 23, but can be urged apart manually.

A webbing strap 33 is mounted on the body 25. The strap 33 passes along the outside of each leg 29 in a recess in the outer surfaces of the legs, is fed around a friction bar 35*a*, 35*b* formed in each leg 29 and passes through the opening 32 to form a loop 36 which projects into the space between the legs 29. The strap 33 is held in place near one end by rivet 37 on leg 29*a* and its free ends 39 extend beyond the forward end 27 of the body 25. The ends 39 carry respective parts 41, 42 of a touch and hold fastener such as VELCRO (Trade Mark) to enable them to be secured together around the mast 5 to hold the coupling member 21 in place against the mast 5. The size of the loop 36 can be adjusted by feeding the strap around the friction bar 35*b* on leg 29*b*.

Figure 3:
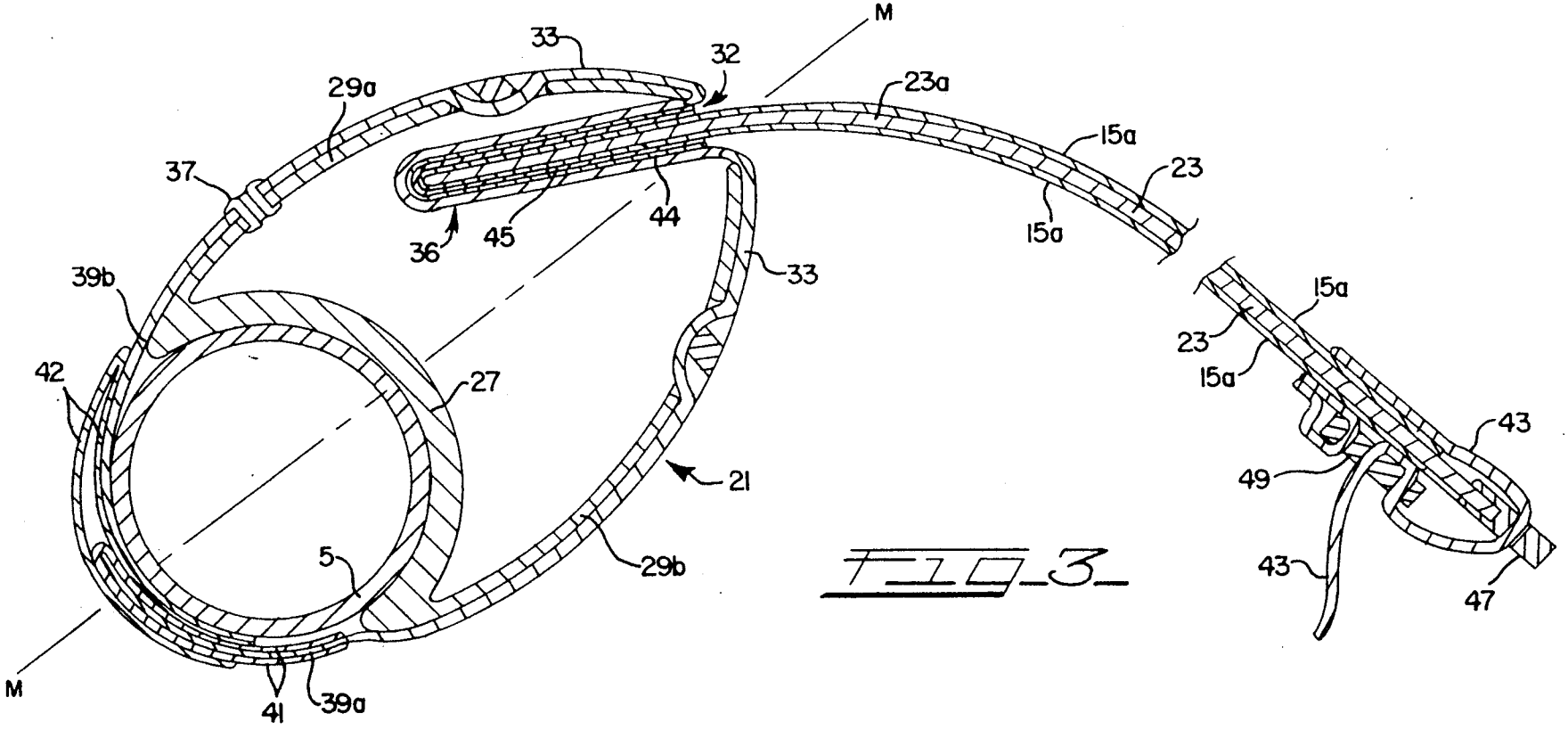
FIG. 3 is a cross-section along the line III—III of FIG. 2.

Referring to FIG. 3, the leading end of the main batten pocket 15*a* is positioned about six inches above the level of the boom 13. The distance will vary in practice because the boom height is user variable. The forward end 27 of the coupling member body sits against the mast 5 and the strap ends 39*a*, 39*b* overlap at the far side of the mast, the touch and hold fastener 41, 42 holding the coupling member 21 in place, but allowing it to pivot or swing about the mast 5.

The leading end of the batten pocket 15*a*, and hence the leading end 23*a* of the batten 23, is received in the loop 36. The end 23*a* of the batten 23 is thus held away from the mast 5 by the loop 36 in the coupling member 21. The end 23*a* of the batten is able to pivot between the legs 29 to lay against either leg as the windward side of the sail is changed, and the coupling member serves to induce a curvature, or camber, into the batten as the batten end aligns with a respective leg 29.

In the unenhanced sail, without the coupling member 21 fitted, the mast 5, which has a curvature induced in it by the sail rigging (at the clew 14 and the bottom of the mast), imparts a corresponding force on, inter alia, the sail area of main batten pocket 15*a*, tending to urge it towards the mast. This is balanced by sail rigging as aforesaid. When the sailboard is being used, changes in the various forces on the sail, including the wind and the boardsailor, result in a shifting of the balance between the forces, and cause movement of the batten 23 (and the other battens) relative to the mast. The addition of the coupling member 21 serves, inter alia, to limit the extent of this relative movement, and so stabilise the foil shape of the sail. The coupling member 21 acts as an over centre cam. The loop 36, whose length is adjustable, is arranged to urge the batten 23 away from the mast when the batten extends along a median line m—m of the coupling member 21. The force on the batten 23 acting towards the mast 5 causes the end 23*a* of the batten to pivot to one side (as seen in FIG. 3), where it tends to move past the mast 5, but is, in fact, restrained from doing so by the coupling member 21. This in turn enhances the camber on the batten 23 and stabilises the draft (curvature) of the sail.

If the wind drops the coupling member tends to hold the enhanced curvature in the batten, and so retain the foil shape in the sail.

Respective parts 44, 45 of a touch and hold fastener, such as VELCRO (Trade Mark) line the loop 32 and the end of the batten pocket 15*a* to hold the coupling member 21 in place on the batten pocket 15*a* when the pressure urging the batten into the mast is released, which may happen for example when the board jumps over rough water, and against general vertical movement of the batten end relative to the mast 5.

The tension imparted by the batten 23 itself, to stiffen the sail, is carried by the batten pocket end and not by the loop 32 in coupling member 21. It is thought that by isolating this force from the loop 32 (by having a closed pocket end) the ability of the cam and batten to flip overcentre is enhanced, the load on the coupling member 21 being primarily the mast straightening load.

The batten 23 is made more flexible towards its leading end, for example by being of reduced cross-section, so that the curvature at the leading edge of the sail is greatest for the desired foil shape. The leading end of the batten pocket 15*a* is reinforced by a sheet 50.

Figure 5:
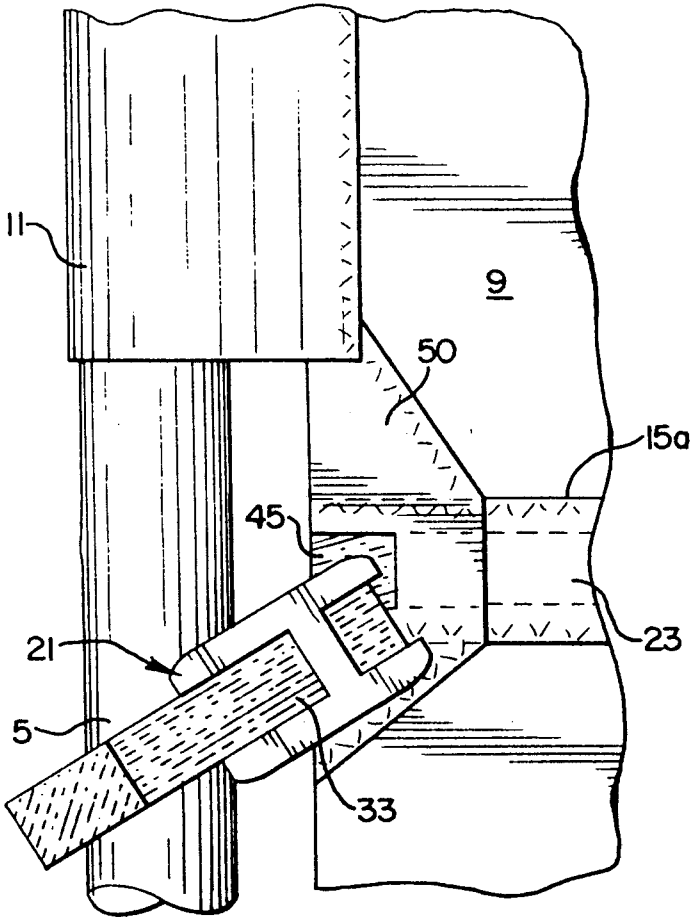
FIG. 5 illustrates the installation of the coupling member of FIG. 4 on a rigged sailboard in accordance with the invention.

By positioning the coupling member 21 in the region of a cut-out in the luff pocket 17, it can be readily installed and removed whilst the sailboard is fully rigged, that is the sail and boom are mounted on the mast 5. Referring to FIG. 5, the leading end of pocket 15*a* is eased out of the plane of the mast and the coupling member 21 is twisted into position over the end of the batten pocket 15*a*, the forward end 27 straddling the mast 5. The strap ends 39*a*, 39*b* are then secured together, leaving the camber inducer free to pivot about the mast 5 whilst holding batten end 23 in position relative to the mast 5 and limiting its movement.

The induced camber can be varied by adjusting the length of the loop 32 prior to installing the coupling member 21.

To remove the coupling member 21, the strap ends 39*a*, 39*b* are released and the coupling member is pivoted downwards to uncouple it from the end of the batten pocket.

Various modifications may be made to the described embodiment. For example, the leading end of the batten pocket 15 may be openable so that the force applied to the batten 23 by the strap 43 may be transmitted directly to the coupling member 21. Also, more than one batten may have an associated removable coupling member 21, a cutout being provided in the luff pocket, and indeed the invention is not limited to sails having luff pockets enclosing the mast. The batten 23 need not be housed in a pocket per se but may be held on the sail body by straps. It is desired to include all such modifications as fall within the scope of the accompanying claims.

What is claimed is:

1. Sailboard apparatus comprising a board, a mast mounted on the board by a universal joint, a sail supported on the mast and having a luff pocket which encircles the mast and extends over a substantial length thereof, an arcuate boom supported at one end by the mast and at another end thereof by a trailing edge of the sail, a main batten pocket housing a main batten extending from the trailing edge of the sail to a forward edge of the sail adjacent the mast and adjacent said sail boom where the luff pocket is discontinued, said forward edge of said sail and an adjacent region of said mast defining a space therebetween, and a coupling member mounted in said space, said coupling member being mounted at one end on said mast and arranged to swivel about said mast, and being coupled to said batten pocket and the main batten at said forward edge of said sail.

2. Apparatus as claimed in claim 1, wherein said coupling member comprises an integrally molded body having a pair of arms which extend rearwardly from said mast to either side of said main batten pocket.

3. Apparatus as claimed in claim 2, wherein said arms support a flexible loop therebetween and said batten pocket end and said batten end are received in said flexible loop to restrain said main batten end against forward movement towards said mast whilst allowing said main batten end to pivot relative to said mast.

4. Apparatus as claimed in claim 1, wherein said coupling member is mountable in said space and removable therefrom while said sail is fully rigged on said mast.

5. In combination, a sailing apparatus comprising a sail mounted on a mast having a luff pocket which encircles the mast and extends over a substantial part thereof, and at least one batten mounted on the sail and extending towards the mast; and a coupling member comprising an integrally molded body for locating an end of said at least one batten relative to the mast, a batten pocket for said at least one batten extending from a trailing edge of the sail to a forward edge of the said sail adjacent the mast where the luff pocket is discontinued to define a space between said forward edge and said mast, the body being mounted to the mast in said space for movement circumferentially of the mast and being coupled to the batten end.

6. The combination of claim 5, wherein the body comprises a forward portion adapted to bear against the mast and a rearward portion arranged to be coupled to the batten end, said body including holding means for holding the batten end spaced from the mast.

7. The combination of claim 6, wherein the holding means is adjustable to adjust the spacing between the batten end and mast.

* * * * *